US006290022B1

(12) United States Patent
Wolf et al.

(10) Patent No.: US 6,290,022 B1
(45) Date of Patent: Sep. 18, 2001

(54) SOUND ABSORBER FOR SOUND WAVES

(75) Inventors: Franz Josef Wolf, Bad Soden-Salmunster; Anton Wolf, Gelnhausen; Udo Gärtner, Wächtersbach, all of (DE)

(73) Assignee: Woco Franz-Josef Wolf & Co. (DE)

( * ) Notice: Subject to any disclaimer, the term of this patent is extended or adjusted under 35 U.S.C. 154(b) by 0 days.

(21) Appl. No.: 09/402,559

(22) PCT Filed: Aug. 12, 1999

(86) PCT No.: PCT/EP99/00765

§ 371 Date: Dec. 21, 1999

§ 102(e) Date: Dec. 21, 1999

(87) PCT Pub. No.: WO99/40567

PCT Pub. Date: Aug. 12, 1999

(30) Foreign Application Priority Data

Feb. 5, 1998 (DE) ..... 198 04 467

(51) Int. Cl.[7] ..... E04B 1/82

(52) U.S. Cl. ..... 181/292; 181/286; 181/293; 181/295

(58) Field of Search ..... 181/295, 293, 181/292, 290, 286, 285, 288, 210, 211, 30, 202, 203, 204, 205

(56) References Cited

U.S. PATENT DOCUMENTS 3,983,955 * 10/1976 Vasiljevic ..... 181/33 G
4,231,447 * 11/1980 Chapman ..... 181/213
4,244,439 * 1/1981 Wested ..... 181/210
4,291,080 * 9/1981 Ely et al. ..... 428/116
4,421,455 * 12/1983 Tomren ..... 415/119
4,787,473 * 11/1988 Fuchs et al. ..... 181/224
5,587,564 * 12/1996 Stief et al. ..... 181/295

FOREIGN PATENT DOCUMENTS 33 22 189 * 1/1985 (DE) ..... 181/210
44 04 502 * 8/1995 (DE) ..... G10K/11/16
58053641 * 3/1983 (JP) ..... 123/195 C
03161603 * 7/1991 (JP) ..... 181/210

* cited by examiner

*Primary Examiner*—Robert E. Nappi
*Assistant Examiner*—Edgardo San Martin
(74) *Attorney, Agent, or Firm*—Arthur G. Yeager

(57) ABSTRACT

The broadband surface-like absorber of the invention is used, in particular, for absorbing troublesome airborne noise in the acoustic frequency range. The broadband surface-like absorber, which operates on the Helmholtz resonator principle, is distinguished by a checkerwork of irregular construction, the webs of which are aligned with their narrow sides perpendicular to the principal surface of the perforated plate and the side edges of which are connected in a sound-pressure-resistant and fluidtight manner on the sound side to the rear side of the perforated plate and, on the rear side, to an extended-area cavity boundary aligned with the same orientation as the perforated plate to form differently tuned chamber resonators.

20 Claims, 1 Drawing Sheet

SOUND ABSORBER FOR SOUND WAVES

CROSS-REFERENCE TO RELATED INVENTIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The invention relates to a surface-like absorber for troublesome sound waves, in particular for troublesome airborne sound waves.

2. Description of Related Art

The use of Helmholtz resonators with a very wide variety of dimensions for damping airborne noise is known from a very wide variety of areas in industry, for example for building applications from German Offenlegungsschrift DE 195 22 363 A1 and, for the area of motor-vehicle construction, from German Offenlegungsschrift DE 196 15 917 A1, DE 196 13 875 A1 or DE 37 29 765 A1.

The disadvantage common to these known Helmholtz absorbers, which act as broadband absorbers, in some cases by design, in others more or less on the empirical level and in other cases unintentionally and unwittingly, is that they are large and bulky.

Taking this prior art as a starting point, the object on which the invention is based is to provide a surface-like sheet absorber for sound waves, in particular airborne sound waves, which can be tuned in a specifically intended manner and can be used more widely and in a more flexible manner for an extremely wide variety of applications but especially in motor-vehicle construction, without having to be adapted beforehand to predetermined installation conditions.

BRIEF SUMMARY OF THE INVENTION

The invention achieves this object by means of a surface-like sheet absorber with the features stated in claim 1.

The essential idea of the invention is based, first of all, on providing a large-area sound absorber, in particular airborne sound absorber, which is capable of damping sound waves from the space surrounding it in a wide, tuneable frequency range by Helmholtz resonance without being tied from the outset to geometrical configurations or dimensions determined by the application. To be more precise, the invention thus provides a broadband surface-like sheet absorber, the sound absorption characteristics of which are, as it were, an adjustable surface property which is both independent of the intended application of the absorber and, especially, independent of the external shape and external dimensions of the absorber. As regards independence from the external dimensions of the surface-like absorber, it should, of course, be noted that there is a minimum total surface area of the absorber required for a response in a predetermined broad frequency band. This minimum surface area must be at least large enough to include the number of resonators tuned in this way required to cover the specified frequency band with at least a minimum overlap between the bands of the individual resonators.

As already mentioned above, another special distinguishing feature of the broadband surface-like sheet absorber is its modular construction. A particular component frequency of the broad band to be absorbed, more precisely a particular narrow frequency band with a width preferably in a range between about 100 Hz and 300 Hz, specifically with a width in a range of 200 Hz to 300 Hz, is therefore not implemented merely by a single resonator chamber as in the applications known from German Offenlegungsschrift DE 196 13 875 A1 or DE 196 15 917 A1 but by a plurality or multiplicity of smaller identical resonator chambers distributed over the entire surface of the broadband surface-like absorber.

The simplest way of obtaining a surface-like sheet absorber of this kind is by attaching, preferably welding or adhesively bonding, in a fluidtight manner, a perforated plate to an extended-area trough provided with a chamber structure by a checkerwork, more precisely on the upper edges of said trough, which lie at least essentially in one plane, the sequence of cup-like depressions formed in the trough by the checkerwork being associated in such a way with the holes formed in the perforated plate that each of the chambers is associated with a precise, precalculated number and distribution of holes, i.e. resonance openings, which, for their part, have an opening area, preferably a circular opening area, and height which is in each case configured to match the absorption distribution curve of the associated resonator chamber or determine and generate the shape of these absorption characteristic curves of the individual resonator chambers.

The distribution of the in each case identically tuned resonator chambers over the surface of the broadband surface-like absorber preferably corresponds to as homogeneous a random distribution as possible, the formation of sequential distributions preferably being completely avoided. However, this can and should not necessarily exclude the formation of relatively large repeats in practice in the case of absorbers with relatively large overall areas. Overall, however, care should preferably be taken to ensure that the spacing between the individual identically tuned chamber resonators in the principal plane of the surface-like absorber is never greater than $\lambda/2$, $\lambda$ being the principal wavelength or "rated wavelength" of the resonance absorption of the respective chamber resonator. This measure makes it possible to prevent the formation of standing waves of this narrow frequency band or this interference wave on the surface of the broadband surface-like absorber.

According to a further refinement of the invention, the overall structure of the broadband surface-like absorber is not rigid but is flexurally elastic or flexible in order, in this way, to allow it to be adapted over a wide area to non-planar surfaces where it is used. This is achieved by the choice of suitable plastics for the production of the surface-like absorber. When the broadband surface-like absorber is constructed in this way, however, care should be taken to ensure that the chamber structure does not become so soft that it no longer forms a stable resonant frequency, i.e. can no longer couple to the interference waves to be absorbed.

A further refinement of the invention envisages that tuning of the individual chamber resonators in respect of predetermination of the chamber volumes is performed not just by changing the basic area of the chamber in the direction of the principal plane of the surface-like absorber but also by a tuning adjustment of the chamber depth calculated from the underside of the perforated plate closing off the chamber on the sound side to the bottom surface remote from the sound. In this refinement of the adaptation of the chamber volume, a bottom thickness which is segmented in accordance with the checkerwork structure and changes abruptly and hence increased strength is achieved for the rear wall of the surface-like absorber. In addition, this feature makes possible a more flexible configuration of the individual sequences of chambers in the surface-like absorber.

In a surface-like absorber constructed in the manner described above, the absorption frequencies or the narrow absorption frequency bands of the individual groups of chamber resonators are preferably tuned in such a way that, when they absorb adjacent frequency ranges, they overlap one another over a width of around 50 Hz. As the absorption curves measured on test absorbers show, such an overlap bandwidth in a range of around 50 Hz to 10 kHz is sufficient to make the broad band of a surface-like absorber constructed in this way to appear as a closed broad band without gaps in the absorption. However, this does not mean that the surface-like absorber must always be constructed in this way. If it is important, for the purpose of sound-deadening a motor vehicle for example, to damp a specific frequency range around 50 Hz, on the one hand, and a specific frequency range between about 600 and 1 kHz, on the other hand, it is not necessary to provide the surface-like absorber with resonators which also damp the intermediate range, that is to say the range between 100 Hz and 600 Hz in the example chosen here. This allows either the overall area of the surface-like absorber to be reduced or, as an alternative, an audible improvement in the performance of the absorber under comparable test conditions while retaining identical overall areas.

For series production of the broadband surface-like absorbers of the invention, the checkerwork and the rear cavity base are preferably of one-piece construction, being made, in particular, of a thermoplastic elastomer or a flexible plastic, while the perforated plate is made of a laminated plastic material, likewise resilient or plastically flexible, with a thickness in a range between 0.5, in particular 1.5 mm and up to 5 mm, in particular up to 3 mm. In this arrangement, the rear part in the form of a cup-shaped trough and the perforated plate are preferably bonded to one another.

It is also perfectly possible for a surface-like absorber constructed in this way to be produced as yard ware that can be cut to size and to be sold in ready made-up form both for commercial purposes and for home use.

More specifically, however, such broadband surface-like absorbers are carefully tuned and used as insulating material for the series production of motor vehicles and, in this context, in particular, for lining the interior of the motor vehicle, especially for the interior lining of a steel roof as a so-called "headliner", for lining the engine compartment or as an aeroacoustic cladding for the underbody of the motor vehicle.

By virtue of their adaptability to an extremely wide variety of use situations, the surface-like absorbers according to the invention are also suitable for use as surface-like absorbers for walls and ceilings in the construction of buildings and in connection with sound barriers for emission control.

BRIEF DESCRIPTION OF THE SEVERAL VIEWS OF THE DRAWING

The invention will be explained in greater detail below with reference to an embodiment example in conjunction with the figures, in which.

DETAILED DESCRIPTION OF THE INVENTION

Figure 1:
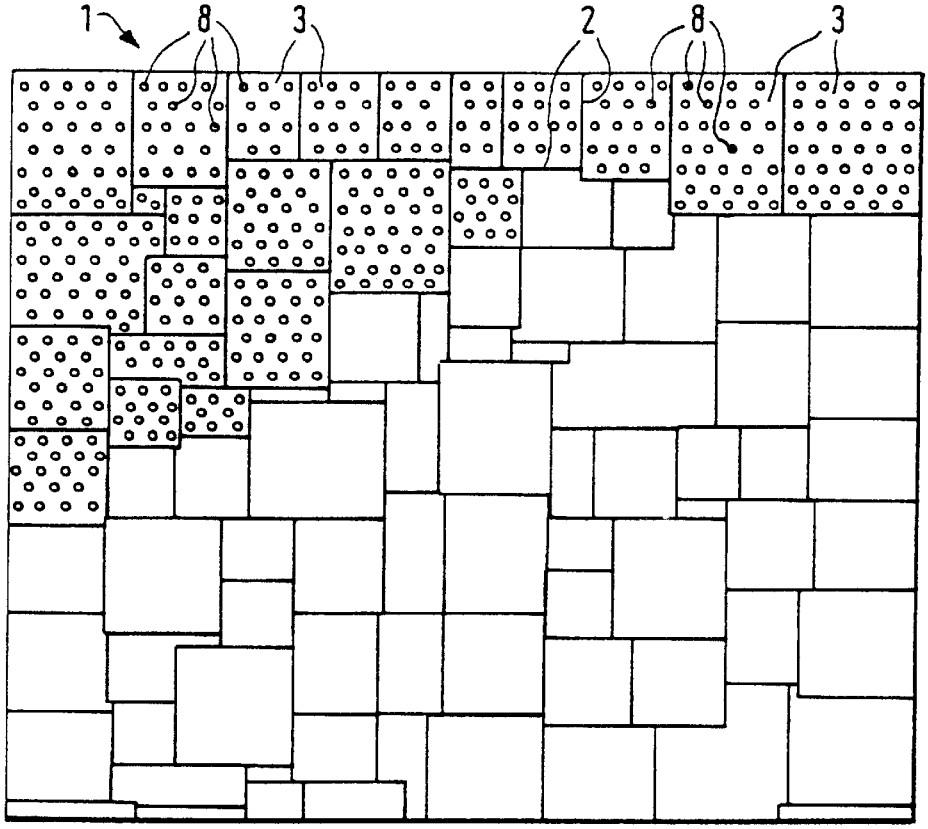
FIG. 1 is a plan view of the perforated plate illustrating an embodiment example of a broadband surface-like absorber with the features of the invention.
Figure 2:
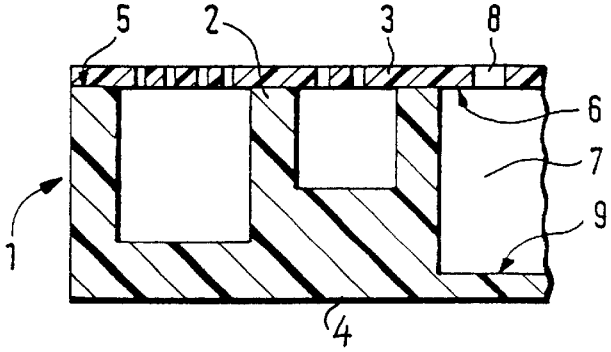
FIG. 2 shows a variant embodiment example of a surface-like absorber with the features of the invention in an enlarged schematic partial representation and in a section perpendicular to the plane shown in FIG. 1.
Figure 3:
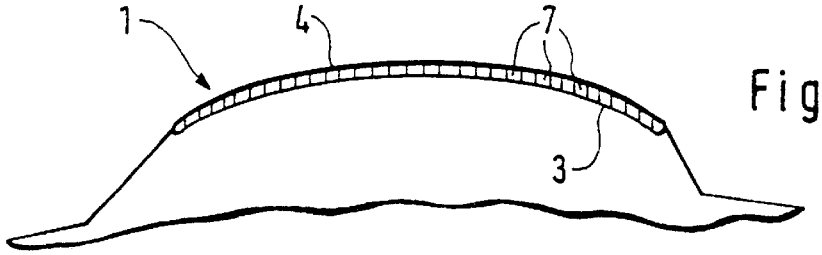
FIG. 3 shows the use of the surface-like absorber as an interior roof lining in the passenger cell of a passenger vehicle likewise in a schematic representation.

As can be seen most clearly in FIG. 2, the embodiment example shown in FIGS. 1 to 3 of a broadband surface-like absorber 1 with the features of the invention comprises a checkerwork 2, a perforated plate 3 and a surface-like rear cavity boundary 4 on the other side of the checkerwork. The checkerwork 2 and the rear cavity boundary 4 are produced in one piece from a comparatively stiff, flexible thermoplastic elastomer and, overall, form a trough-shaped or jig-like structure divided into chambers. The surface-like upper edges 5 of the individual webs of the checkerwork 2 geometrically define a continuous surface, preferably a plane or a surface with only a slight curvature. In this plane, the perforated plate 3, which is designed as a strong plastic sheet, is bonded to the upper edges 5 of the checkerwork 2 in a fluidtight manner and in a manner resistant to sound pressure. More particularly, this bond with the rear side 6 of the perforated plate 3, the said rear side facing away from the sound chamber to be damped, is made by welding or, as in the embodiment example described here, by adhesive bonding.

While, in the embodiment example shown in FIG. 2, an integrally formed perforated plate 3 is adhesively bonded to the rear trough structure 2, 4, it is also possible, in the manner shown in FIG. 1, for the perforated plate to be made up of individual parts which are each applied separately or, if appropriate, in the form of repeating groups, to the individual resonator chambers 7 (FIG. 2).

Whether the perforated plate is in one piece, as illustrated in FIG. 2, or made up of a plurality of individual parts, as shown in FIG. 1, this perforated plate has through-openings 8 in all cases. The volume of these openings 8 is filled with the fluid which surrounds the surface-like absorber and in which the sound waves to be damped propagate. The mass of the fluid enclosed in the volume of the hole, almost always air, corresponds to the oscillatory mass which, together with the volume of fluid enclosed in the resonator chambers 7, said volume acting as a spring, forms the Helmholtz resonator.

FIG. 2 gives a schematic representation, by way of example, of three differently tuned Helmholtz chamber resonators 7. This figure shows specifically how tuning can be performed. Thus, in the case of formation of the rear cavity boundary 4 in one piece with the checkerwork 2, the volume of the chambers can be determined either by varying the cross section of the individual resonator chambers 7 or by varying their depths, measured from the underside 6 of the perforated plate 3 to the bottom surface 9 of the chambers, the bottom surface 9 of the individual resonator chambers 7 corresponding to the inner surface of the rear cavity boundary 4 of the surface-like absorber, said inner surface facing towards sound. The depth of the individual resonator chambers 7 is here varied by varying the thickness of the rearward cavity boundary 4 from chamber to chamber.

Each of the resonator chambers 7 can be assigned two or more or even a multiplicity of openings 8 in the schematically depicted manner. While the axial eight of the individual openings 8 in the embodiment example shown in FIG. 2 is uniformly determined for all the resonator chambers 7 by the thickness of the sheet used for the perforated plate, the assembled perforated plate of the type shown in FIG. 1 has the advantage that the axial height of the individual openings 8 can also be varied from chamber to chamber, thus allowing the third spatial dimension, the Z axis as it were, to be used for tuning the oscillatory mass to achieve differentiated tuning of the absorption per unit area.

While the structure of the broadband surface-like absorber shown in FIG. 1 is obviously particularly suitable for experimental purposes or for special production runs, the embodiment shown in FIG. 2 is suitable especially for series production.

When the surface-like absorber in accordance with the invention is designed as yard ware for DIY enthusiasts and tradesmen, it is also possible to use a perforated-plate sheet provided uniformly or at random with through-openings and for it to be applied and joined to the underlying structure in a more or less random manner in a continuous production process. This makes it possible to achieve good distribution of the resonance absorption while also achieving good to average absorption performance. A broadband surface-like absorber of this kind, especially one produced by a continuous process, is distinguished by a broad, varied range of applications and the ability to be cut to size.

In areas of application where higher requirements apply both to the absorption performance and the spectral distribution of the absorption characteristics, on the other hand, for example to allow acoustic styling of noises within passenger cells of motor vehicles, very careful structural definition of the absorption characteristics of the surface-like absorber is required.

For applications on which higher requirements are made, the perforated plates or perforated-plate sections are associated very accurately with the individual preformed resonator chamber volumes. Here, the trough-like structure is formed with a predetermined number of groups of resonator chambers 7, each with the same chamber volume, in such a way that these resonator chambers are distributed randomly and as homogeneously as possible and, as far as possible, without forming sequential patterns over the surface of the surface-like absorber, more specifically with the proviso that the spacing between each resonator chamber in each group and the adjacent resonator chamber in the direction of the main surface of the surface-like absorber is less than $\lambda/2$, where "$\lambda$" is the wavelength of the main resonant frequency, more precisely the mean resonant frequency, of the resonance band, which is narrow relative to the broadband absorption of the surface-like absorber overall. Such a distribution of the individual resonator chambers, which is indicated schematically in FIG. 1, prevents the formation of standing waves over the entire broad band of absorption of the surface-like absorber over the entire surface of the surface-like absorber, however this surface may be configured.

In a broadband surface-like absorber constructed in this way, the individual chambers of each group preferably have an absorption band width in a range of about 100 Hz to 300 Hz, preferably a bandwidth of 200 Hz to 300 Hz, their bandwidths overlapping with those of respective groups of resonator chambers of higher and lower frequencies, with a frequency width preferably of the order of about 50 Hz. Such finely tuned broadband surface-like absorbers not only allow comprehensive general absorption of troublesome noise in motor-vehicle construction, for example, but also "acoustic styling" for the individual types of motor vehicle, an application of growing significance in motor-vehicle construction. The absorption profiles to be achieved in each particular case can be achieved in a highly accurate manner by computer-assisted simulation without the need for empirical trials.

Such flexible configuration and adjustability of the absorption characteristics of the broadband surface-like absorber of the invention in conjunction with the mechanical/structural flexibility with which these surface-like absorbers can be produced opens up new areas of application in many fields of applications engineering for the broadband surface-like absorbers of the invention, particularly, for instance, in the field of motor-vehicle construction, building construction and, more generally, of environmental noise protection. In the field of motor-vehicle construction, special mention may be made of the use of surface-like absorbers to insulate the passenger cells of passenger vehicles against the emission of structure-borne noise into the interior and as aeroacoustic underbody cladding for vehicles.

The use of the absorber for lining the roof of passenger vehicles is illustrated schematically in FIG. 3 as an example of a use of the broadband surface-like absorber in accordance with the invention.

A structural flexible broadband surface-like absorber in accordance with the invention is connected over its entire area with the inner surface of the roof panel of a motor vehicle, preferably being welded or adhesively bonded to it, in the manner shown in FIG. 3. Connecting it to the steel roof structure of the motor vehicle in this way ensures a high degree of stiffening and stabilization for the resonator chamber structure and the checkerwork despite the flexible design of the overall structure of the surface-like absorber. At the same time, the perforated plate of the broadband surface-like absorber with its opening diameters of 1 to 3 mm at the maximum, said perforated plate facing the interior of the passenger cell of the motor vehicle, offers free scope to the designer in its capacity as a headliner without this design activity affecting the technical functionality of the broadband surface-like absorber. Here, therefore, technical and artistic design can be applied freely and independently of one another to the same design element. Technically, the result in all cases is acoustic calming of the passenger cell of a standard that cannot be obtained, for example, with the prior art known from German Offenlegungsschrift DE 37 29 765 A1 already cited at the outset.

Significantly better results than those that can currently be obtained with conventional rubber underbody coating can also be achieved with the broadband surface-like absorber when it is used for underbody insulation in passenger vehicle construction.

What is claimed is:

1. Surface like-sheet absorber for sound waves in fluids with frequencies in the acoustic range, comprising a sound-side perforated plate having a length and width and holes (8) extending through the thickness of said plate and a closed cavity situated behind and connected to said perforated plate, said absorber cavity having a random and irregular checkerwork (2) throughout said length and width including a plurality of spaced and aligned webs with their narrow sides perpendicular to a principal surface of said perforated plate (3) and their long side edges (5) connected in a soundpressure-resistant and fluidtight manner to a rear side (6) of said perforated plate (3), said cavity having a two-dimensionally extended cavity boundary (4) aligned with the same orientation as said perforated plate and spaced therefrom to form a plurality of chamber resonators (7) of different volumes.

2. Surface-like sheet absorber according to claim 1, characterized in that said checkerwork (2) is formed in one piece with said extended cavity boundary (4) forming a separate, trough-like, extended-area structural unit (2, 4) divided into cup-like chambers, said perforated plate (3) being fixed on its sound side to said chambers.

3. Surface-like sheet absorber according to claim 1, characterized in that said absorber (3, 2, 4) is flexible so that it can be applied over its full area to uneven or curved supporting or boundary surfaces.

4. Surface-like sheet absorber according to claim 1, characterized in that said chamber resonators (7) include a plurality of differently tuned groups of identically tuned chamber resonators distributed the entire surface of said absorber (1), said chamber resonators of each said groups having a homogenous and random but nonsequential distribution, and spacing between any identically tuned chamber resonators in each said group being no greater than $\lambda/2$, where $\lambda$ is the wavelength of a sound wavelength to be damped.

5. Surface-like sheet absorber according to claim 1 characterized in that said absorber (1) has an at least substantially uniform thickness which can be adjusted, given predetermined chamber volumes, by appropriate tuning of said chamber resonators by way of number and arrangement of said holes (8) in said perforated plate (3) opening into said chamber resonators (7), and by way of cross section and axial depth of said holes (8).

6. Surface-like sheet absorber according to claim 1, characterized by said chamber resonators (7) being tuned to a sound-absorption frequency band width in a range of about 100 Hz to 300 Hz.

7. Surface-like sheet absorber according to claim 1, characterized by said chamber resonators (7) forming a plurality of groups of differently tuned chamber resonators (7), each said group overlapping with the next to produce a continuous broadband effect of said absorber (1) with a frequency band of about 50 Hz.

8. Surface-like sheet absorber according to one of claims 1 to 7, characterized by said perforated plate being formed of a laminated plastic material and said checkerwork and the rear cavity boundary wall being formed from a comparatively hard elastomer compound.

9. The use of a broadband surface-like sheet absorber (1) according to one of claims 1 to 7 as soundproofing material for lining the interior of motor vehicles, as aeroacoustic underbody cladding for motor vehicles, as or for the construction of engine encapsulation in motor-vehicle engine compartments or as surface-like wall and ceiling absorbers in building construction and in connection with noise barriers for emission control.

10. Surface-like sheet absorber for sound waves in fluids with frequencies in the acoustic range, with a sound-side perforated plate (3) and a closed cavity (2, 4, 5, 7, 9) situated behind the plate (3) and connected to the perforated plate (3), the closed cavity having a random distribution of an irregular checkerwork (2) throughout and the webs of which are aligned with their narrow sides perpendicular to the principal surface of the perforated plate (3) and the long side edges (5) of which are connected in a sound-pressure-resistant and fluidtight manner on the sound side to the rear side (6) of the perforated plate (3) and, on the rear side, to a two-dimensionally extended cavity boundary (4) aligned with the same orientation as the perforated plate to form chamber resonators (7) of different volumes, the checkerwork (2) being formed in one piece with the rear cavity boundary (4) forming a separate, trough-like, extended-are structural unit 2, 4) divided into cup-like chambers separated by the webs forming common walls of adjacent cup-like chambers.

11. Surface-like sheet absorber according to claim 10, characterized in that the surface flexibility of the absorber structure (3, 2, 4) is adjusted in such a way that the latter can be applied over its full area even to uneven or curved supporting surfaces or boundary surfaces.

12. Surface-like sheet absorber according to claim 10, characterized in that a plurality of differently tuned groups of identically tuned chamber resonators is distributed over the entire surface of the absorber (1) so that the individual chamber resonators of each group have a homogenous and random but nonsequential distribution, the spacing between the individual identically tuned chamber resonators in each group in the principal plane of the absorber (1) being no greater than $\lambda/2$, where $\lambda$ is the wavelength of a sound wavelength to be damped.

13. Surface-like sheet absorber according to claim 10 characterized in that the absorber (1) is substantially of uniform thickness which can be adjusted, given predetermined chamber volumes, by appropriate tuning of the individual chamber resonators (7) of the absorber (1) by way of the number and arrangement of the holes (8) in the perforated plate (3) opening into the chambers and by way of the clear cross section and axial depth of these holes (8).

14. Surface-like sheet absorber according to claim 10, characterized by chamber resonators which are each tuned to a sound-absorption frequency band width in a range of about 100 Hz to 300 Hz.

15. Surface-like sheet absorber according to claim 10, characterized by a plurality of groups of differently tuned chamber resonators, each group of which overlaps with the next to produce a continuous broadband effect of the absorber (1) with a frequency band of the order of about 50 Hz.

16. Surface-like sheet absorber according to one of claims 10 to 15, characterized by a laminated plastic material as the performated plate and one-piece integral construction of the checkerwork and the rear cavity boundary wall from a comparatively hard elastomer compound, in particular a thermoplastic elastomer.

17. The use of a broadband surface-like sheet absorber (1) according to one of claims 10 to 15 as soundproofing material for lining the interior of motor vehicles, as aeroacoustic underbody cladding for motor vehicles, as or for the construction of engine encapsulation in motor-vehicle engine compartments or as surface-like wall and ceiling absorbers in building construction and in connection with noise barriers for emission control.

18. Surface-like sheet absorber for sound waves in fluids with frequencies in the acoustic range, comprising a sound-side perforated plate having holes (8) therethrough and a closed cavity situated behind and connected to said perforated plate, said absorber cavity having an irregular and randomly sized checkerwork (2) throughout including a plurality of space and aligned webs with their narrow sides perpendicular to a principal surface of said perforated plate (3) and their long side edges (5) connected in a soundpressure-resistant and fluidtight manner to a rear side (6) of said perforated plate (3), said cavity having a two-dimensionally extended cavity boundary (4) aligned with the same orientation as said perforated plate and spaced therefrom to form a plurality of chamber resonators (7) of different volumes said checkerwork (2) is formed in one piece with said extended cavity boundary (4) forming a separate, trough-like, extended-structural unit (2, 4) divided into cup-like chambers, said perforated plate (3) being fixed on its sound side to said chambers.

19. Surface-like sheet absorber according to claim 18, characterized in that said absorber (3, 2, 4) is flexible so that it can be applied over its full area to uneven or curved supporting or boundary surfaces.

20. Surface-like sheet absorber according to either of claims 18 or 19, characterized in that said chamber resonators (7) include a plurality of differently tuned groups of identically tuned chamber resonators distributed the entire surface of said absorber (1), said chamber resonators of each said groups having a homogenous and random but nonsequential distribution, and spacing between any identically tuned chamber resonators in each said group being no greater than $\lambda/2$, where $\lambda$ is the wavelength of a sound wavelength to be damped.

* * * * *